US006532913B1

(12) United States Patent
Opris

(10) Patent No.: US 6,532,913 B1
(45) Date of Patent: Mar. 18, 2003

(54) PISTON COOLING FIN

(75) Inventor: Cornelius N. Opris, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/995,566

(22) Filed: Nov. 27, 2001

(51) Int. Cl.[7] ..... F02F 3/22
(52) U.S. Cl. ..... 123/41.35; 123/193.6
(58) Field of Search ..... 123/41.35, 193.6

(56) References Cited

U.S. PATENT DOCUMENTS

| | | | | |
|---|---|---|---|---|
| 1,628,652 A | | 5/1927 | Carlson | |
| 2,463,025 A | | 3/1949 | Dilworth | |
| 2,523,699 A | | 9/1950 | Holt et al. | |
| 2,609,799 A | | 9/1952 | Brill | |
| 2,991,769 A | * | 7/1961 | Chapin | 123/41.35 |
| 3,136,306 A | | 6/1964 | Kamm | |
| 4,161,165 A | | 7/1979 | Belush et al. | |
| 4,175,502 A | | 11/1979 | Moebus | |
| 4,368,697 A | | 1/1983 | Moebus | |
| 4,587,932 A | | 5/1986 | Moebus | |
| 5,052,280 A | * | 10/1991 | Kopf et al. | 123/41.35 |
| 5,144,923 A | | 9/1992 | Leites et al. | |

* cited by examiner

*Primary Examiner*—Noah P. Kamen
(74) *Attorney, Agent, or Firm*—Jason J Stanley

(57) ABSTRACT

Modern internal combustion engines produce high temperatures and pressures in the combustion chamber of the engine that place immense stresses on the engine's pistons. These temperatures and pressures can cause pistons to deform or wear and prematurely fail. One of the primary means of overcoming these detrimental effects on a piston is increasing the efficiency of heat rejection from the piston. One method of increasing the amount of heat drawn away from the piston is increasing the surface area of the inner surface of the piston crown so that a cooling medium, such as oil, can contact the inner surface and draw heat therefrom. Installing or forming an annular fin in the underside of the piston increases the surface area for oil to contact and permits precise targeting of piston locations from which heat is to be evacuated. Such annular fins can be quickly and easily installed or formed for use with any type of pistons, such as forged, cast, composite or mechanically joined pistons.

25 Claims, 6 Drawing Sheets

PISTON COOLING FIN

TECHNICAL FIELD

This invention relates generally to an engine and more particularly to the cooling of a piston by placing a fin within a cooling recess of the piston.

BACKGROUND

Internal combustion engine manufacturers continually strive to decrease the physical size of engines and increase the power output per cylinder. In doing so, the manufacturer strives to increase fuel economy, efficiency, and service life, while reducing emissions. One way of improving efficiency and reducing size has been to increase temperatures and pressures in the combustion chamber. However, such increased temperatures and pressures in the combustion chamber place higher stresses on the piston that may cause the piston to deform or wear and prematurely fail.

One of the primary means of overcoming these detrimental effects on the piston is increasing the efficiency of heat rejection from the piston. For example, many high output engines employ cooling of the underside of the piston by spraying a cooling medium against the underside of the piston. The cooling medium absorbs a portion of the heat from the piston, falls away from the piston to the pan, is cooled and recycled to cool the piston again. To ensure efficient cooling of the underside of the piston, the spray must be precisely directed and retained to best remain in contact with the underside of the piston and absorb heat therefrom.

A method of increasing the contact between the oil and the interior of the piston is by increasing the surface area of the interior of the piston, thereby providing more area for the oil to contact and absorb heat. U.S. Pat. No. 2,523,699 issued to G. A. Holt et al. on Sep. 26, 1950 shows a series of ribs projecting inwardly from the interior wall of the piston skirt. These ribs increase the heat dissipating area of the piston that is in contact with the oil as the oil is shaken by the reciprocating motion of the piston. The intricate piston design set forth in Holt, however, is very difficult to produce via forging or machining processes. Therefore, the piston disclosed in Holt is practical for use solely in casting processes. However, the casting process introduces impurities into the cast product. These impurities decrease the density of the product and thus decrease the product's resistance to deformation at high temperatures and pressures.

The present invention is directed to overcoming one or more of the problems as set forth above.

SUMMARY OF THE INVENTION

In one aspect of the present application, a piston has a top portion having a bowl and a periphery portion. The bowl has an annular bowl that is attached to and extends radially inward from the periphery portion. Each of the annular bowl and the periphery portion has an inner surface. The piston has an outer annular wall that extends axially from the periphery portion of the top portion of the piston. The outer annular wall has an inner surface. The annular bowl inner surface, the periphery portion inner surface, and the outer annular wall inner surface define a cooling gallery. The piston has at least one annular fin that extends from the cooling gallery.

In another aspect of the present application, a method of creating a piston includes providing a piston having a top portion and an outer annular wall as described above and introducing to the cooling gallery at least one annular fin.

DETAILED DESCRIPTION

Referring to the figures, an internal combustion engine 10 is shown. The engine 10 includes a cylinder block 12, a cylinder head 14 attached to the block 12, a valve cover 16 attached to the head 14, and a cooling system (not shown). These components are of a generally conventional design.

Figure 1:
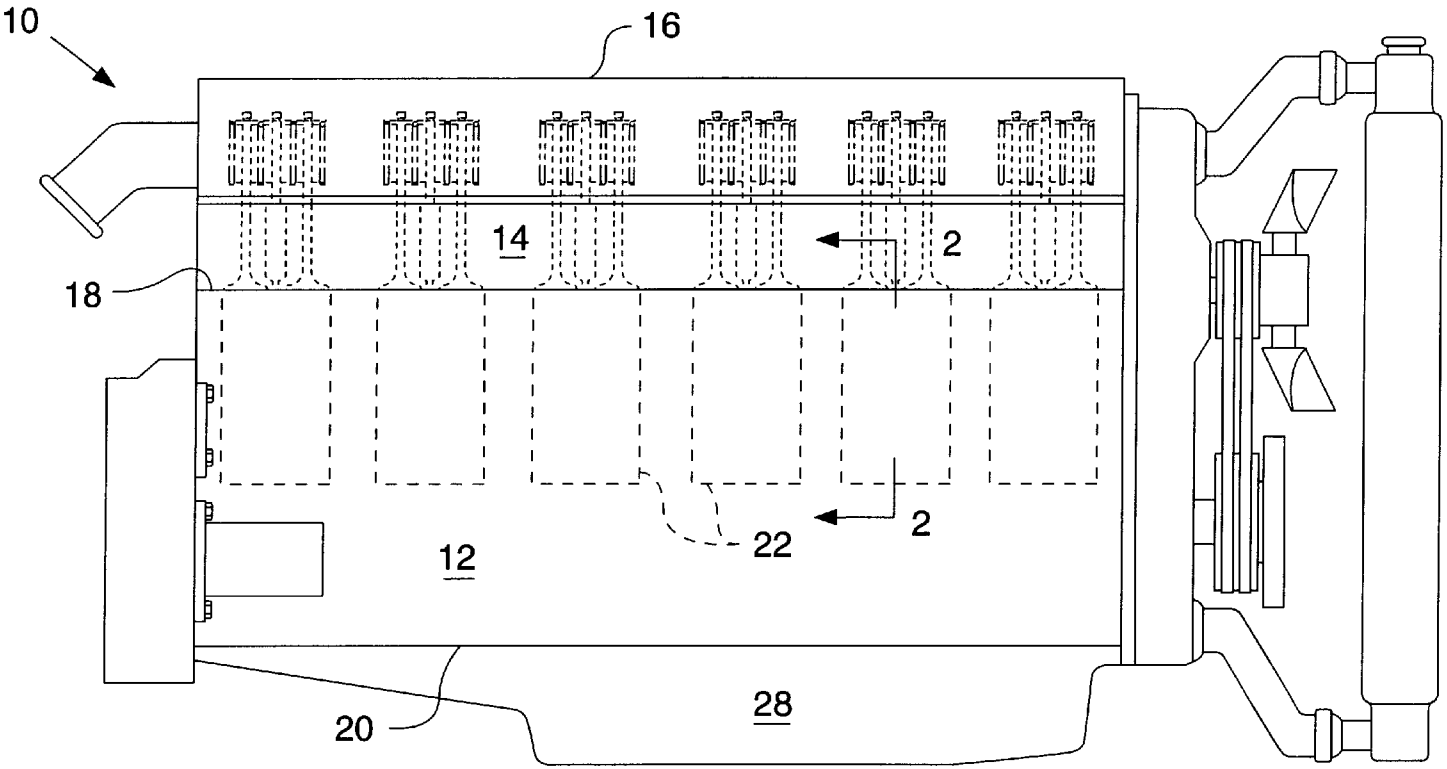
FIG. 1 is a side view of an engine.
Figure 2:
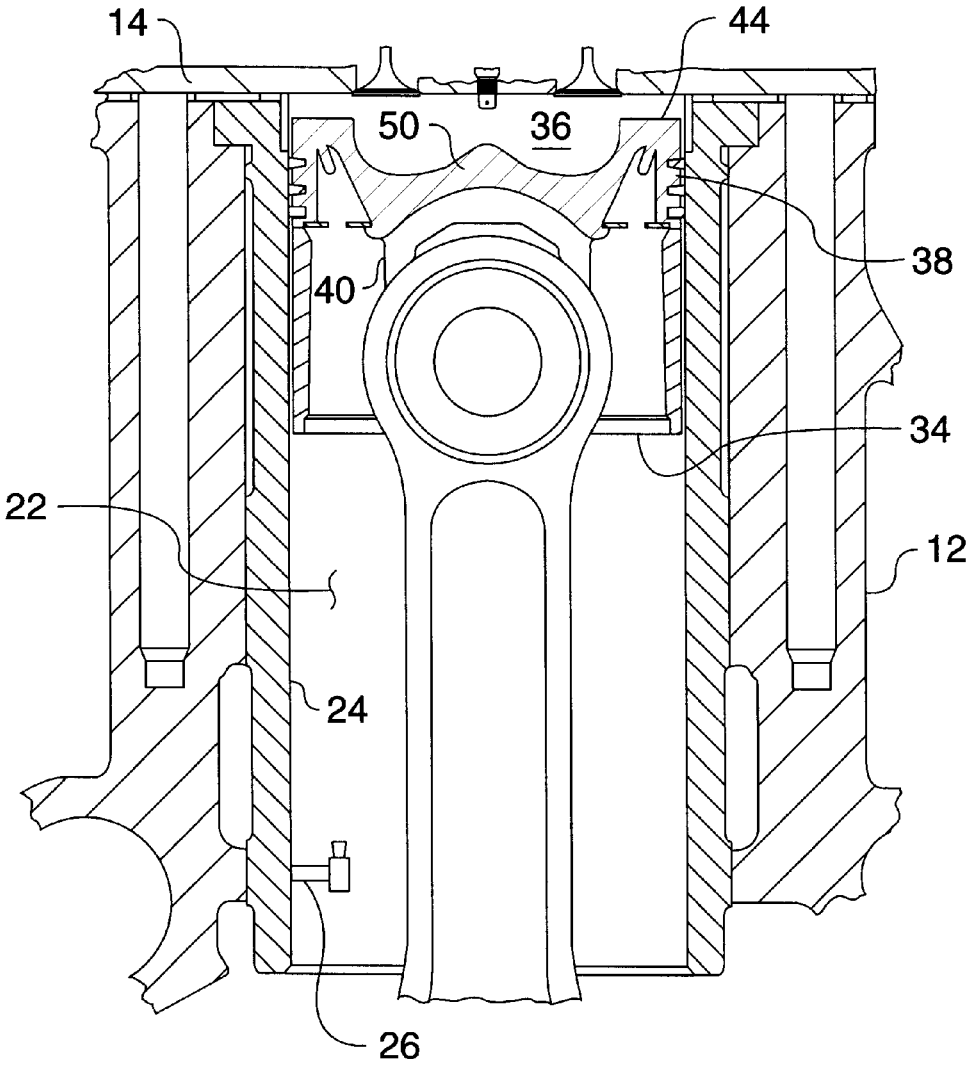
FIG. 2 is a cross sectional view taken along line 2—2 of FIG. 1 of the engine.

Referring now to FIG. 1, the block 12 includes a top mounting surface 18, a bottom mounting surface 20, and a plurality of cylinder bores 22 located between the top mounting surface 18 and the bottom mounting surface 20. In the embodiment shown in FIG. 1, six cylinder bores 22 are equally spaced, in-line, and perpendicularly positioned with respect to the top mounting surface 18. However, the cylinder block 12 may be of any other conventional design, such as "V" or radial, and may have any number of bores 22. As shown in FIG. 2, each bore 22 defines a cylinder wall 24. In the engine shown in FIG. 2, a cylinder liner is placed in the bore 22 to form the cylinder wall 24. However, the apparatus and method described in the present application may be used in engines that do not contain cylinder liners. The cylinder block 12 has a plurality of interconnected passages (not shown) to enable the flow of a lubricating and/or cooling medium, such as oil (not shown). Secured to the block 12 and connected to the cooling passages are a plurality of coolant directing nozzles 26. The block 12 also has an oil pan 28, shown in FIG. 1, connected to the block 12.

Referring to FIG. 2, a piston 34 is slidably positioned within the cylinder wall 24 of the cylinder block 12. The piston 34, the cylinder wall 24, and the cylinder head 14 define a combustion zone 36. The piston 34 is a generally cylindrical structure having a top portion 38 and a pin portion 40. In FIG. 2, the piston 34 is shown as one piece. However, the piston 34 may be any conventional piston type, including an articulated piston or a composite piston.

Figure 3:
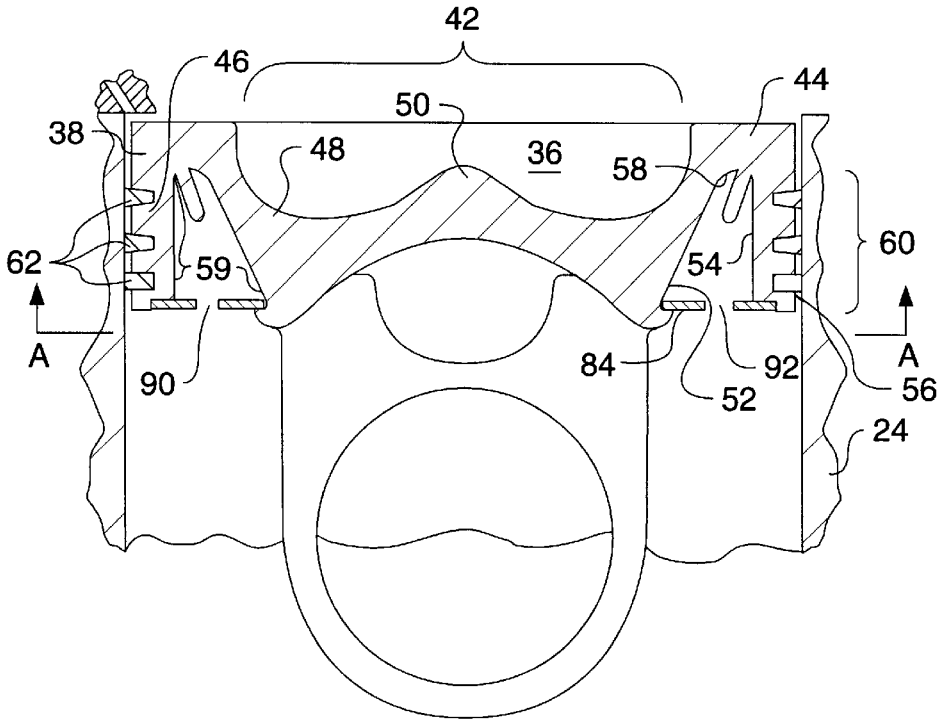
FIG. 3 is an enlarged cross sectional view of a piston within the engine.

Referring now to FIG. 3, the top portion 38 is further defined by a bowl 42, a periphery portion 44, and an outer annular wall 46. The bowl 42 is defined by an annular bowl 48 connected with the periphery portion 44. The annular bowl extends radially inward from the periphery portion 44 and connects to a conical section 50 forming an apex. The annular bowl 48 has an inner surface 52 separated from the combustion zone 36. In the piston 34 shown in FIG. 3, the periphery portion 44, the annular bowl 48, and the conical section 50 are integrally formed. As shown in FIG. 2, the distance from the apex of the conical section 50 to the cylinder head 14 is generally greater than the distance from the periphery portion 44 to the cylinder head 14.

Referring again to FIG. 3, the periphery portion 44 extends radially away from the bowl 42 towards the cylinder wall 24. The outer annular wall 46 extends axially away from the periphery portion 44 towards the pin portion 40. The outer annular wall 46 has an inner surface 54 and an outer surface 56. The periphery portion 44 has an inner surface 58 that is separated from the combustion zone 36. The periphery portion inner surface 58 is connected to, and integral with, the inner surface 52 of the annular bowl 48 and the inner surface 54 of the outer annular wall 46. The inner surface 58 of the periphery portion 44, the inner surface 52 of the annular bowl 48, and the inner surface 54 of the outer annular wall 46 define a crown interior surface 59. The outer surface 56 has a sealing portion 60 in which any conventional manner of providing sealing between the piston 34 and the cylinder wall 24, such as a plurality of piston rings 62, can be formed.

Figure 4:
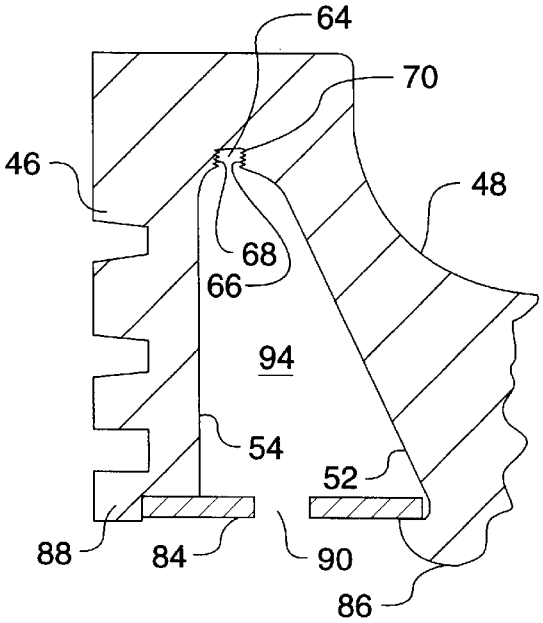
FIG. 4 is an enlarged sectional view of an annular groove in the piston.
Figure 5:
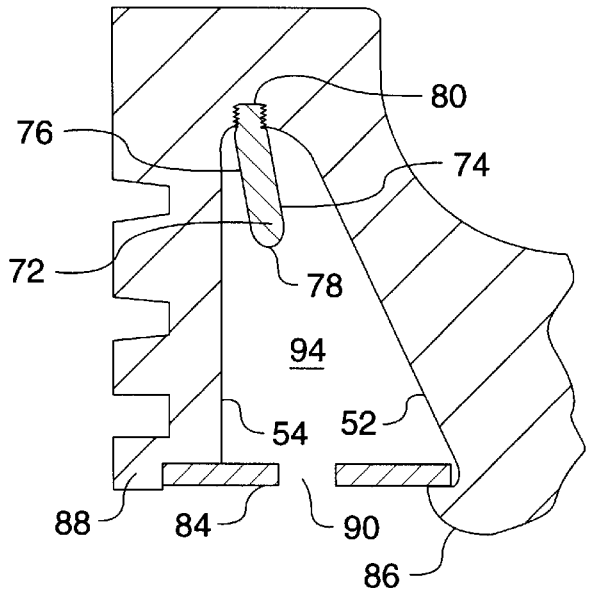
FIG. 5 is an enlarged sectional view of an annular fin attached to the piston.
Figure 6:
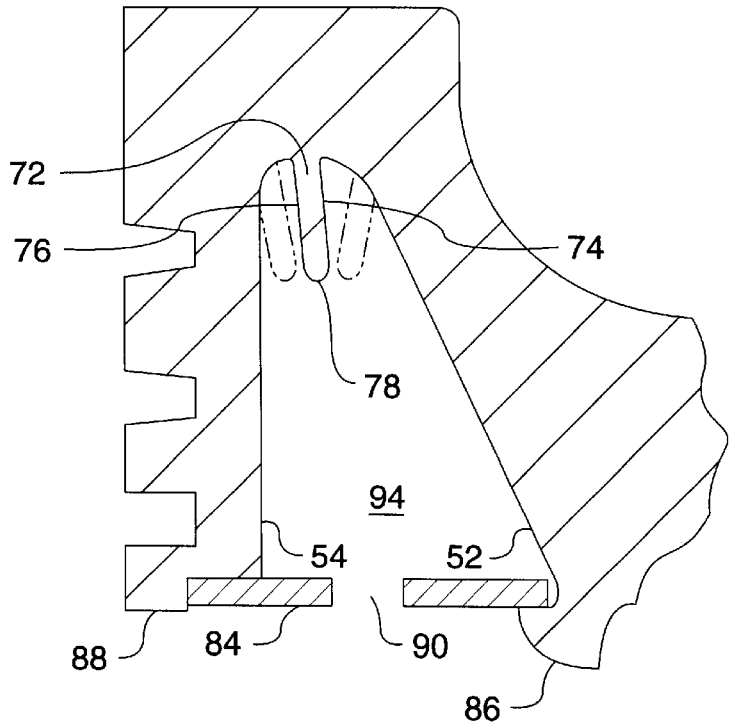
FIG. 6 is a sectional view of an annular fin that is integral with the piston.

In one embodiment of the piston 34 set forth in the present application, shown in FIG. 4, an annular groove 64 is located in the crown interior surface 59. The annular groove 64 has an inner wall 66 and an outer wall 68. One or both of the inner wall 66 and the outer wall 68 may have a thread 70 formed thereon. As shown in FIG. 5, an annular fin 72 is attached to one or both of the inner wall 66 and the outer wall 68 of the annular groove 64. The annular fin 72 has an inner surface 74, an outer surface 76, a first edge 78, and a second edge 80. One or both of the outer surface 76 and the inner surface 74 may have a thread 82 formed thereon. The location and dimensions of the annular fin 72, including diameter, thickness, and length, are predetermined. In another embodiment of the piston 34 of the present application, shown in FIG. 6, the annular fin 72 is integrally formed with the crown interior surface 59. In other embodiments of the piston, shown in shadow in FIG. 6, a plurality of the annular fins 72 may be attached to, or integral with, the crown interior surface 59.

Figure 7:
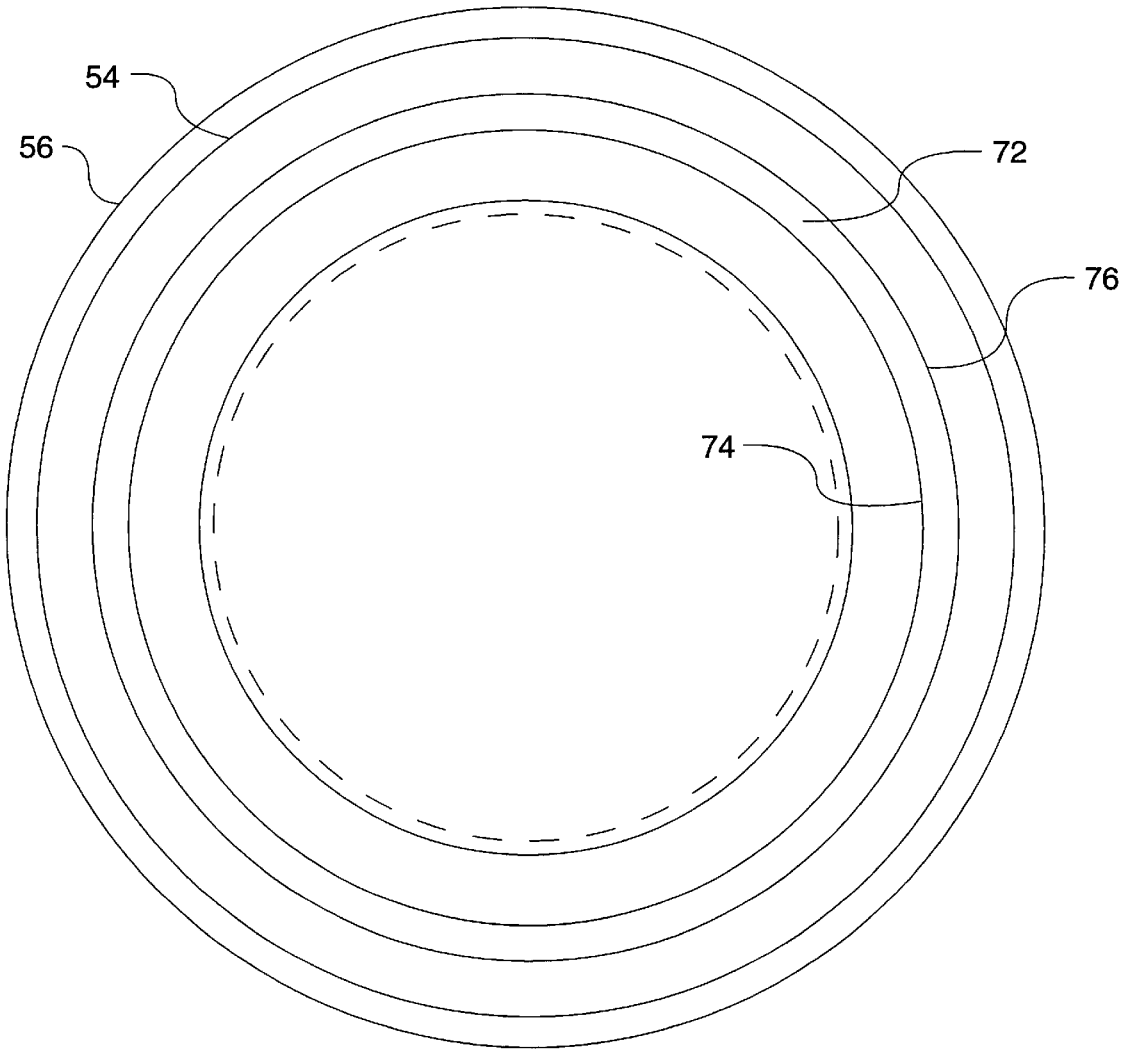
FIG. 7 is a bottom partially sectioned view taken along line A—A of FIG. 3 of the piston without a baffle plate.
Figure 8:
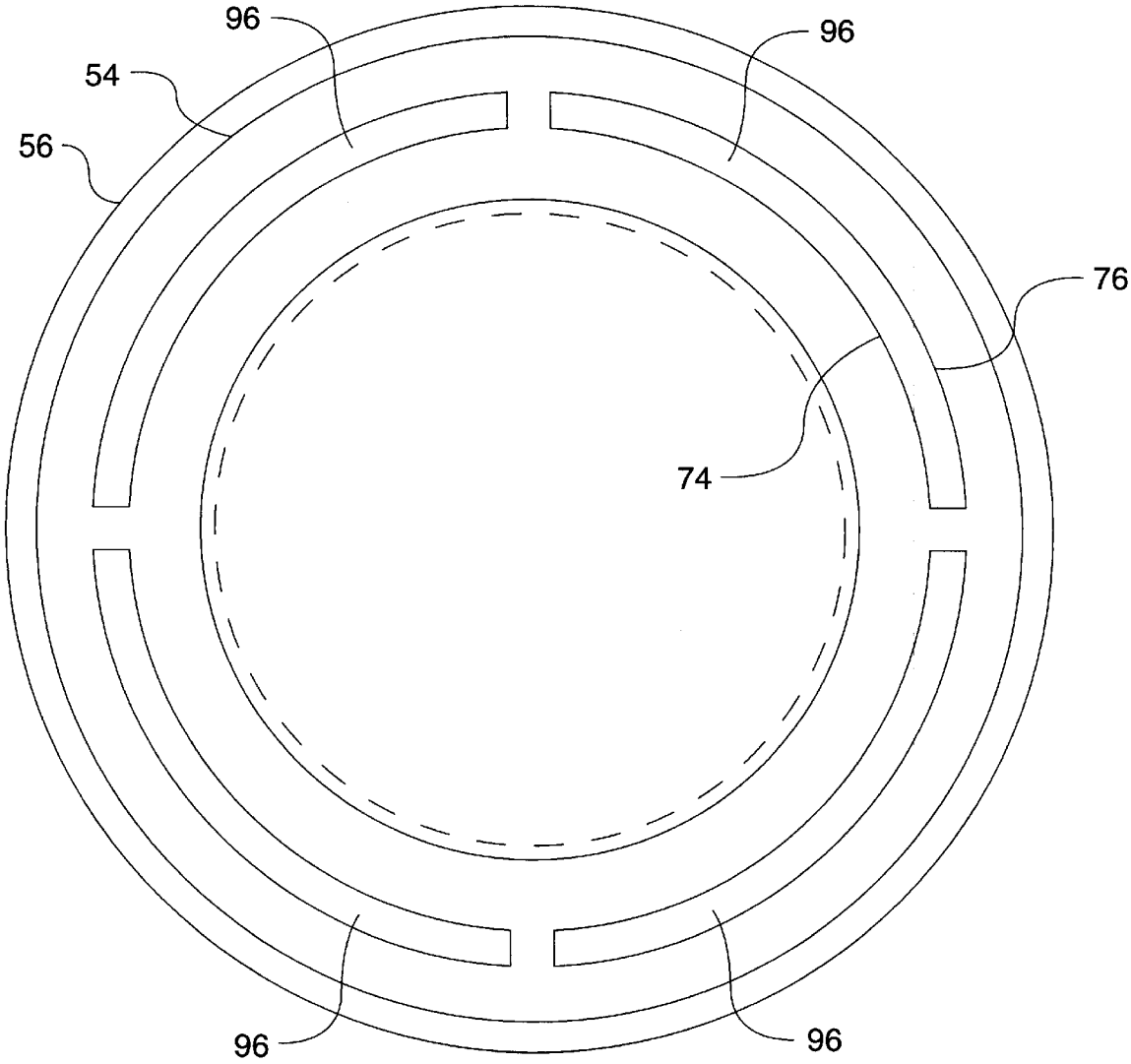
FIG. 8 is a bottom partially sectioned view taken along line A—A of FIG. 3 of the piston without a baffle plate and having a plurality of fin sections.

In one embodiment of the piston 34 of the present application, shown in FIG. 5, a baffle plate 84 is connected between a lip portion 86 on the inner surface 52 of the annular bowl 48 and a lower edge portion 88 of the inner surface 54 of the outer annular wall 46. The baffle plate 84 has a receiving aperture 90 therethrough and a draining aperture 92, shown in FIG. 3, therethrough. The baffle plate 84, the crown interior surface 59, the inner surface 74 of the annular fin 72, the first edge 78 of the annular fin 72, and the outer surface 76 of the annular fin 72 define a cooling gallery 94. In other embodiments of the apparatus, as shown in FIG. 7, a baffle plate is not present. Although shown in FIG. 7 as one continuous piece, the annular fin 72 may be defined by a plurality of fin segments 96, as shown in FIG. 8.

INDUSTRIAL APPLICABILITY

The location and dimensions of the annular fin 72 are determined by examining various factors. One primary factor is the location in the piston 34 from which heat needs to be dissipated. For example, if the temperature of the annular bowl 48 of the piston 34 needs to be reduced, the diameter of the annular fin 72 may be selected to ensure that the annular fin 72 will contact the area of the inner surface 52 of the annular bowl 48 that will effect the proper heat reduction. Another factor affecting the annular fin 72 dimensions is the magnitude of the heat that is to be evacuated from the piston 34. An annular fin 72 with a larger surface area will draw more heat from the piston 34. In addition, a thin annular fin 72 will dissipate more heat than a thick one. The amount of stress placed upon the piston 34 by the introduction of the annular fin 72 is another factor that influences the annular fin's location and dimensions. The physical dimensions of the piston 34 itself also affect the size and location of the annular fin 72. If the piston contains the baffle 84, the optimal dimensions of the annular fin 72 will depend upon the size of the enclosed cooling gallery 94. The size of the annular fin 72 and the angle at which it protrudes from the crown interior surface 59 may be modified to ensure that the annular fin 72 does not excessively impede the flow of the cooling medium to other portions of the crown interior surface 59 and thereby detrimentally affect the cooling of the piston 34.

One method of attaching the annular fin 72 to the crown interior surface 59 of the piston 34 includes inserting the second edge 80 of the annular fin 72 into the annular groove 64, creating a press-fit connection between the inner surface 74 and outer surface 76 of the annular fin 72 and the inner wall 66 and outer wall 68 of the annular groove 64. Another method is used for embodiments of the piston 34 containing thread 82 on the annular fin 72 or thread 70 in the annular groove 64. In this method, the second edge 80 of the annular fin 72 is placed in the annular groove 64 and the fin 72 is threaded into the groove 64, thereby connecting the annular fin 72 to the piston 34. Both of these methods may be used with pistons of any type, including cast, forged, composite, and mechanically joined, as the annular groove 64 may be easily and expeditiously machined into the crown interior surface 59 of any piston 34.

Another method of the present application, shown in FIG. 5, consists of creating the annular fin 72 as an integral part of the piston 34. In the process of machining the piston 34 and creating the crown interior surface 59, the annular fin 72, containing the inner surface 74, the outer surface 76, and the first edge 78, that extends from the crown interior surface 59 and that is integral with the piston 34 is formed. This method may be practiced with forged pistons by simply altering the machining process currently used to create the crown interior surface 59 of forged pistons 34.

The annular fin 72 may also be made integral with the piston 34 via a method that includes inertial welding. In such a method, either the annular fin 72, the piston 34, or both, are rotated at high velocity. If both are rotated, they are typically rotated in opposite directions. The annular fin 72 and the piston 34 are then brought together quickly with the annular fin 72 contacting the crown interior surface 59 at the predetermined location. The heat created by the friction between the annular fin 72 and the piston 34 welds them together, making the fin 72 integral with the piston 34.

The addition of the annular fin 72 to the crown interior surface 59 of the piston 34 effects heat attenuation of the portions of the piston 34 that are subject to the highest temperatures and pressures. A cooling medium, such as oil, flows through the cooling passages of the engine 10. The cooling medium is sprayed by the coolant directing nozzle 26 onto the crown interior surface 59 of the piston 34. If the piston 34 has the baffle 84, the cooling medium enters the cooling gallery 94 through the receiving aperture 90 and contacts the crown interior surface 59 and the annular fin 72. The cooling medium absorbs heat from the crown interior surface 59 and the annular fin 72. This absorption of heat is greater than that in a piston 34 without an annular fin 72 because the annular fin 72 increases the surface area for the cooling medium to contact the piston 34. In addition, the annular fin's 72 position in the crown interior surface 59 allows the annular fin 72 to draw heat from a specific area of the piston 34. The baffle 84 retains the cooling medium in the cooling gallery 94, causing the cooling medium to absorb more heat from the crown interior surface 59 as the oil is repeatedly brought into contact with the annular fin 72 and the crown interior surface 59 by the reciprocating motion of the piston 34. The cooling medium exits the cooling gallery 94 through the draining aperture 92. After exiting the cooling gallery 94, the cooling medium enters the oil pan 28 and is recirculated through the engine 10 and cooled by the engine cooling system in a conventional manner.

If the piston 34 does not have the baffle plate 84, the cooling medium is simply sprayed directly onto the crown interior surface 59 and the annular fin 72. The cooling medium then absorbs heat from the crown interior surface 59 and the annular fin 72 and falls back into the oil pan 28. The cooling medium is then recirculated through the engine 10 and cooled by the engine cooling system in the conventional manner.

The apparatus and method of the present application solves many problems. The apparatus and method may be used in any type of piston, including cast, forged, composite, and mechanically joined. In addition, the apparatus may be quickly and easily installed, decreasing manufacturing costs. The adjustable dimensions and location of the apparatus permit the specific targeting of areas in the piston from which heat is to be removed.

Other aspects, objects, and advantages of this invention can be obtained from a study of the drawings, the disclosure, and the appended claims.

What is claimed is:

1. An internal combustion engine, said engine comprising:

a cylinder block, said block having at least one bore;

a piston slidably positioned in said bore, said piston having a crown interior surface, said crown interior surface defined by an annular bowl inner surface, a periphery portion inner surface, and an outer annular wall inner surface;

at least one annular fin extending from at least one of said periphery portion inner surface and a portion of said crown interior surface proximate to said periphery portion inner surface; and a lubricating and cooling system.

2. The internal combustion engine as specified in claim 1 wherein said crown interior surface has an annular groove therein, said annular groove having an inner wall and an outer wall, and said at least one annular fin has an inner surface and an outer surface, at least one of said annular fin inner surface and said annular fin outer surface attached to at least one of said annular groove inner wall and said annular groove outer wall.

3. The internal combustion engine as specified in claim 2 wherein the attachment between said at least one annular fin and said annular groove is a press-fit attachment.

4. The internal combustion engine as specified in claim 2 wherein at least one of said annular groove inner wall and said annular groove outer wall has a threaded surface, and at least one of said annular fin inner surface and said annular fin outer surface has a threaded surface engaging at least one of said annular groove inner wall threaded surface and said annular groove outer wall threaded surface, respectively.

5. The internal combustion engine as specified in claim 1 wherein said at least one annular fin is integral with said crown interior surface.

6. The internal combustion engine as specified in claim 1 wherein said piston is a forged piston.

7. The internal combustion engine as specified in claim 1 wherein said piston is a cast piston.

8. The internal combustion engine as specified in claim 1 wherein at least one of the thickness, length, and diameter of said at least one annular fin is predetermined.

9. The internal combustion engine as specified in claim 1 wherein said at least one annular fin is defined by a plurality of annular fin segments.

10. A piston for use in an internal combustion engine, said piston comprising:

a crown interior surface defied by an annular bowl inner surface, a periphery portion inner surface, and an outer annular wall inner surface; and at least one annular fin extending from at least one of said periphery portion inner surface and a portion of said crown interior surface proximate to said periphery portion inner surface.

11. The piston as specified in claim 10 wherein said crown interior surface has an annular groove therein, said annular groove having an inner wall and an outer wall, and said at least one annular fin has an inner surface and an outer surface, at least one of said annular fin inner surface and said annular fin outer surface attached to at least one of said annular groove inner wall and said annular groove outer wall.

12. The piston as specified in claim 11 wherein the attachment between said at least one annular fin and said annular groove is a press-fit attachment.

13. The piston as specified in claim 11 wherein at least one of said annular groove inner wall and said annular groove outer wall has a threaded surface, and at least one of said annular fin inner surface and said annular fin outer surface has a threaded surface engaging at least one of said annular groove inner wall threaded surface and said annular groove outer wall threaded surface, respectively.

14. The piston as specified in claim 10 wherein said at least one annular fin is integral with said crown interior surface.

15. The piston as specified in claim 10 wherein said piston is a forged piston.

16. The piston as specified in claim 10 wherein said piston is a cast piston.

17. The piston as specified in claim 10 wherein at least one of the dimensions of said at least one annular fin is predetermined.

18. The piston as specified in claim 10 wherein said at least one annular fin is defined by a plurality of annular fin segments.

19. A method of making a piston, said method comprising:

providing a piston having a crown interior surface, said crown interior surface defined by an annular bowl inner surface, a periphery portion inner surface, and an outer annular wall inner surface;

providing an annular fin having an inner surface and an outer surface;

creating an annular groove having an inner wall and an outer wall in at least one of said periphery portion inner surface and a portion of said crown interior surface proximate to said periphery portion inner surface; and attaching at least one of said annular fin inner surface and said annular fin outer surface to at least one of said annular groove inner wall and said annular groove outer wall.

20. The method as specified in claim 19 wherein said annular groove is created by machining said crown interior surface.

21. The method as specified in claim 19 wherein attaching said annular fin to said annular groove is effected by creating a press-fit connection between said inner wall and said outer wall of said annular groove and said inner surface and said outer surface of said annular fin.

22. The method as specified in claim 19 including:

manufacturing at least one thread in at least one of said annular groove inner wall and said annular groove outer wall;

manufacturing at least one thread in at least one of said annular fin inner surface and said annular fin outer surface; and engaging said at least one thread on at least one of said annular groove inner wall and said annular groove outer wall with said at least one thread on at least one of said annular fin inner surface and said annular fin outer surface.

23. A method of constructing a piston, said method comprising:

providing a piston having a crown interior surface, said crown interior surface defined by an annular bowl inner surface, a periphery portion inner surface, and an outer annular wall inner surface; and forming an annular fin having an inner surface, an outer surface, and a first edge in at least one of said periphery portion inner surface and a portion of said crown interior surface proximate to said periphery portion inner surface such that said annular fin extends from and is integral with said crown interior surface.

24. The method as specified in claim 23 wherein forming said annular fin is effected by machining said crown interior surface.

25. The method as specified in claim 23 wherein forming said annular fin includes:

providing an annular fin having an inner surface, an outer surface, a first edge and a second edge;

rotating at least one of said piston and said annular fin;

bringing said annular fin into contact with said crown interior surface such that an inertial weld is created between said annular fin and said crown interior surface.

* * * * *

UNITED STATES PATENT AND TRADEMARK OFFICE

CERTIFICATE OF CORRECTION

PATENT NO. : 6,532,913 B1
DATED : March 18, 2003
INVENTOR(S) : Cornelius N. Opris It is certified that error appears in the above-identified patent and that said Letters Patent is hereby corrected as shown below:

Column 6,
Line 13, delete "defied" and insert -- defined --

Signed and Sealed this

Sixth Day of May, 2003

JAMES E. ROGAN
*Director of the United States Patent and Trademark Office*